United States Patent [19]

Cerquozzi

[11] 4,155,663

[45] May 22, 1979

[54] TOOTHPASTE DISPENSING TOOTHBRUSH HAVING A SQUEEZABLE HANDLE

[76] Inventor: John H. Cerquozzi, c/o J.H.C. Associates Co., 2736 Dove St., Williamsport, Pa. 17701

[21] Appl. No.: 793,834

[22] Filed: May 5, 1977

[51] Int. Cl.[2] ..... A46B 11/02; B43K 5/14

[52] U.S. Cl. ..... 401/135; 401/183; 401/287

[58] Field of Search ..... 401/132-135, 401/183, 184, 287, 278, 273

[56] References Cited

U.S. PATENT DOCUMENTS

| | | | |
|---|---|---|---|
| 2,283,781 | 5/1942 | Aiken | 401/135 |
| 2,807,818 | 10/1957 | Taylor | 401/135 |
| 2,814,816 | 12/1957 | Pepping et al. | 401/278 |
| 2,987,743 | 6/1961 | Capps | 401/278 |
| 3,242,928 | 3/1966 | Peters | 401/273 |
| 3,356,095 | 12/1967 | Tylle | 401/195 |
| 3,400,996 | 9/1968 | Vandergrift | 401/184 |
| 3,417,762 | 12/1968 | Hall | 401/135 |
| 3,738,762 | 6/1973 | Moore et al. | 401/186 |
| 4,049,354 | 9/1977 | O'Rourke | 401/134 |

FOREIGN PATENT DOCUMENTS

| | | | |
|---|---|---|---|
| 49271 | 2/1939 | France | 401/135 |
| 894623 | 3/1944 | France | 401/277 |
| 334574 | 1/1959 | Switzerland | 401/183 |

*Primary Examiner*—Clyde I. Coughenour

*Attorney, Agent, or Firm*—Sughrue, Rothwell, Mion, Zinn and Macpeak

[57] ABSTRACT

A dentifrice dispensing toothbrush comprises a brush head unit, a replaceable toothpaste container and a squeezable outer case surrounding the toothpaste container. The brush head unit is a hollowed shaft having discharge vents at the base of the bristles and having, at the inlet end, a screw-threaded bore terminating in a pointed tip. The toothpaste container has a toothpaste holding chamber whose outlet is closed by a membrane wall pierceable by the pointed tip.

1 Claim, 3 Drawing Figures

TOOTHPASTE DISPENSING TOOTHBRUSH HAVING A SQUEEZABLE HANDLE

PRIOR ART

The following patents are considered pertinent:

U.S. Pat. Nos. 1,164,597, 1,833,434, 1,642,620, 1,432,715, 2,259,981, 2,305,168, 2,358,645, 2,244,952.

BACKGROUND OF THE INVENTION

This invention relates to a dentifrice dispensing toothbrush, and in particular, to a toothbrush having a toothpaste holding chamber from which toothpaste is dispensed onto the bristles when the toothbrush handle is squeezed.

A toothbrush containing a built in source of dentifrice is a useful device, particularly for travelers or for persons who, for various dental health reasons, are required to brush their teeth after every meal. The use of a toothbrush containing a built in reservoir of dentifrice results in a considerable savings of space and can easily be carried around in one's pocket or purse.

SUMMARY OF THE INVENTION

In accordance with the invention, a dentifrice dispensing toothbrush comprises a brush head unit, a replaceable toothpaste container and a squeezable outer case surrounding the toothpaste container. The brush head unit is a hollowed shaft having discharge vents at the base of the bristles and having, at the inlet end, a screw-threaded bore terminating in a pointed tip. The toothpaste container has a toothpaste holding chamber whose outlet is closed by a membrane wall pierceable by the pointed tip.

A principal object of this invention is to provide an improved dentifrice carrying toothbrush of simple and practical construction.

Another object is to provide a dentifrice carrying toothbrush in which the dentifrice is easily dispensed into the bristles.

Still another object is to provide a dentifrice carrying toothbrush in which the dentifrice carrying unit is easily replaceable.

Other objects and advantages of this invention will be readily apparent from the following specification and the drawing.

DETAILED DESCRIPTION OF THE PREFERRED EMBODIMENT

Figure 1:
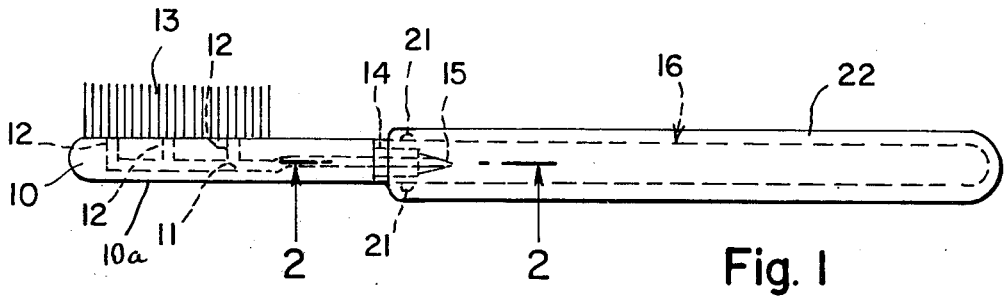
FIG. 1 is a side elevation of the dentifrice carrying toothbrush of this invention.
Figure 2:
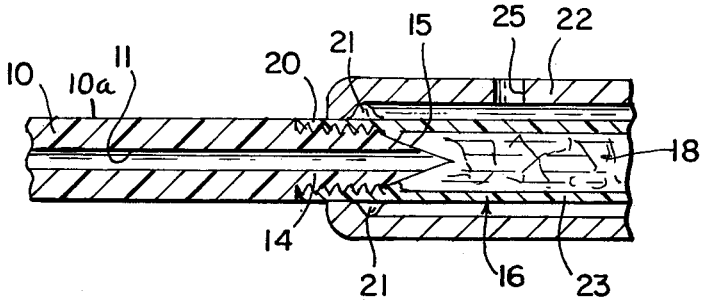
FIG. 2 is a cross-sectional view taken substantially along the plane indicated by line 2—2 of FIG. 1.
Figure 3:
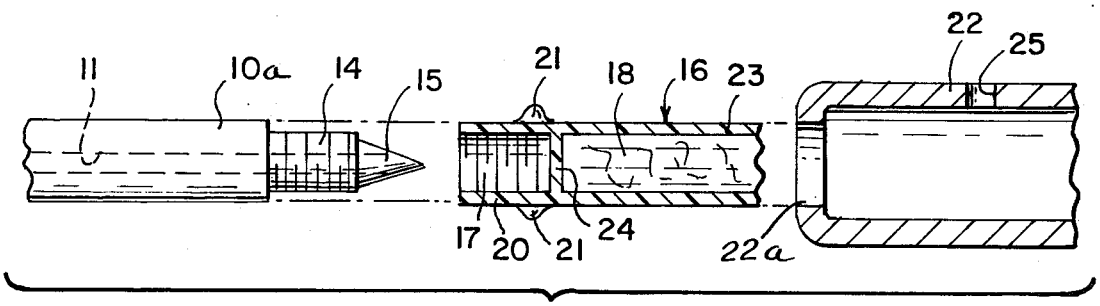
FIG. 3 is an exploded view of the elements of FIG. 2.

The device of this invention comprises a brush head unit 10 comprising a hollowed shaft 10*a* with a channel 11 terminating in one or more discharge vents 12. These vents have openings in a base mounting a plurality of brush bristles 13.

At the end of the brush head unit shaft 10*a* opposite from the bristle members is an externally screw-threaded reduced diameter shaft portion or bore 14, said bore terminating in a pointed tip 15. There is provided a hollow toothpaste container 16 having an orifice chamber 17 and a toothpaste holding chamber 18 separated by a membrane wall 24. The orifice chamber 17 is internally screw-threaded and threadably receives the externally screw-threaded bore 14.

The outer wall 20 of container 16 forming orifice chamber 17 is of a rigid material and contain means, such as annular collar 21, for abutting the end wall of a removable outer case 22. The outer wall 23 of toothpaste holding chamber 18 is constructed of a deformable material such as is commonly found in toothpaste tubes. Separating orifice chamber 17 and toothpaste holding chamber 18 is the membrane wall 24 which is capable of being pierced by pointed tip 15.

The toothpaste container 16 is therefore of like diameter to the hollowed shaft 10*a*, is unitary in form, and provides both an outer wall 20 defining the orifice chamber 17 which is rigid to one side of the pierceable membrane wall 24, and a outer wall 23 which is deformable to hold the toothpaste within chamber 18.

Surrounding toothpaste container 16 is a removable semi-rigid outer case 22, in which container 16 is slid from one end. This outer case is composed of a material which an be depressed in order to make partial contact with the deformable outer wall 23 of toothpaste holding chamber 18. Outer case 22 is removably held in position by collar 21, which forms a portion of the rigid outer wall 20 of orifice chamber 17. Preferably outer case 22 is equipped with an atmospheric vent 25 in order to equalize pressure when the case is squeezed.

The removable semi-rigid outer case 22 is provided with an opening 22*a* within one end which is larger than the outer diameter of toothpaste container 60 but is smaller than the diameter of the annular collar 21 permitting the semi-rigid outer case to be forced axially into concentric position with the annular collar 21 internal of the hollow removable semi-rigid outer case 22.

Connecting the toothpaste container unit 16 to the brush head unit 10 by engaging the screw threads 14 and 17 causes pointed tip 15 to pierce membrane wall 24. Pressure on outer case 22 causes deforming of deformable outer wall 23 with the result that toothpaste flows into channel 11 and through vents 12 onto bristles 13.

While a specific embodiment of a toothpaste dispensing toothbrush having a squeezable handle has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A dentifrice dispensing toothbrush comprising:

a brush head unit including a hollow shaft having, at one end, discharge vents and a plurality of bristle members extending radially outwardly therefrom and being of reduced diameter at its opposite end and terminating in a pointed tip;

a hollow toothpaste container of corresponding diameter including a rigid tubular wall at one end defining an orifice and being threaded on its inner periphery and threadably receiving the reduced diameter portion of said hollow shaft;

an integral, transverse membrane wall pierceable by the pointed tip of the hollow shaft; and a deformable wall extending axially beyond said membrane wall oppositely to said orifice chamber;

and wherein said toothpaste container rigid wall comprises an annular collar projecting radially outwardly therefrom; and a removable semi-rigid outer case surrounding the toothpaste container and having an opening within one end of a diameter slightly in excess to the outer diameter of said toothpaste container, but less than the diameter of said annular collar;

whereby, said removable semi-rigid outer case slidingly receives said toothpaste container with said annular collar inwardly of said opening, said outer case being equipped with an atmospheric vent and said case being constructed such that pressure on said case will cause deforming of the outer wall of the toothpaste holding chamber forcing toothpaste through said hollow shaft and outwardly of said discharge vent at the base of said bristle members.

* * * * *